US011535946B2

(12) United States Patent
Fluegel et al.

(10) Patent No.: US 11,535,946 B2
(45) Date of Patent: Dec. 27, 2022

(54) COMPOSITION FOR TIN OR TIN ALLOY ELECTROPLATING COMPRISING LEVELING AGENT

(71) Applicant: BASF SE, Ludwigshafen am Rhein (DE)

(72) Inventors: Alexander Fluegel, Ludwigshafen (DE); Jean-Pierre Berkan Lindner, Ludwigshafen (DE); Marco Arnold, Ludwigshafen (DE)

(73) Assignee: BASF SE, Ludwigshafen am Rhein (DE)

( * ) Notice: Subject to any disclaimer, the term of this patent is extended or adjusted under 35 U.S.C. 154(b) by 157 days.

(21) Appl. No.: 16/618,222

(22) PCT Filed: May 28, 2018

(86) PCT No.: PCT/EP2018/063889

§ 371 (c)(1),
(2) Date: Nov. 29, 2019

(87) PCT Pub. No.: WO2018/219848

PCT Pub. Date: Dec. 6, 2018

(65) Prior Publication Data

US 2020/0115813 A1 Apr. 16, 2020

(30) Foreign Application Priority Data

Jun. 1, 2017 (EP) ..... 17173987

(51) Int. Cl.
*C25D 3/60* (2006.01)
*C25D 3/32* (2006.01)
*C25D 5/02* (2006.01)

(52) U.S. Cl.
CPC ..... *C25D 3/32* (2013.01); *C25D 3/60* (2013.01); *C25D 5/02* (2013.01)

(58) Field of Classification Search
None
See application file for complete search history.

(56) References Cited

U.S. PATENT DOCUMENTS 3,577,328 A 5/1971 Rynne et al.
4,871,429 A 10/1989 Nobel et al.
(Continued)

FOREIGN PATENT DOCUMENTS

CN 103060860 A 4/2013
CN 103442567 A 12/2013
(Continued)

OTHER PUBLICATIONS

English Translation JP2013023693 (Year: 2013).*
(Continued)

*Primary Examiner* — Stefanie S Wittenberg
(74) *Attorney, Agent, or Firm* — Armstrong Teasdale LLP

(57) ABSTRACT

The present invention relates to the use of an aqueous composition comprising tin ions optionally further alloy metal ions selected from silver, copper, indium, and bismuth ions and at least one additive comprising a linear or branched polyimidazolium compound comprising the structural unit of formula (L1) for depositing tin or tin alloy containing layers and a process for depositing tin alloy layer onto a substrate.

(L1)

14 Claims, 5 Drawing Sheets

(56) References Cited

U.S. PATENT DOCUMENTS

| | | | |
|---|---|---|---|
| 5,174,887 | A | 12/1992 | Federman et al. |
| 7,357,853 | B2 | 4/2008 | Toben et al. |
| 7,628,903 | B1 | 12/2009 | Tsuji et al. |
| 7,781,325 | B2 | 8/2010 | Lee et al. |
| 8,083,922 | B2 | 12/2011 | Orikasa et al. |
| 8,980,077 | B2 | 3/2015 | Romer et al. |
| 9,200,168 | B2 | 12/2015 | Morii |
| 10,201,097 | B2 | 2/2019 | Duan et al. |
| 2006/0016693 | A1 | 1/2006 | Wang et al. |
| 2006/0094226 | A1 | 5/2006 | Huang et al. |
| 2008/0054459 | A1 | 3/2008 | Lee et al. |
| 2008/0296761 | A1 | 12/2008 | Lee et al. |
| 2012/0132530 | A1 | 5/2012 | Hayashi et al. |
| 2013/0068626 | A1 | 3/2013 | Siemer et al. |
| 2016/0298249 | A1 | 10/2016 | Foyet et al. |

FOREIGN PATENT DOCUMENTS

| | | | | | |
|---|---|---|---|---|---|
| EP | 0 854 206 | A1 | | 7/1998 | |
| EP | 1 619 274 | A2 | | 1/2006 | |
| EP | 3 002 350 | A1 | | 4/2016 | |
| JP | 9-272995 | A | | 10/1997 | |
| JP | 09272995 | | * | 10/1997 | ..... C25D 3/32 |
| JP | 4296358 | B2 | | 7/2009 | |
| JP | 2013-23693 | A | | 2/2013 | |
| KR | 20100033952 | A | | 3/2010 | |
| KR | 20160076536 | A | | 6/2016 | |
| WO | WO 2010/069810 | A1 | | 6/2010 | |
| WO | WO 2010/072571 | A1 | | 7/2010 | |
| WO | 2012127009 | A1 | | 9/2012 | |
| WO | WO-2016001317 | A1 | * | 1/2016 | ..... C25D 3/24 |
| WO | WO 2016/020216 | A1 | | 2/2016 | |
| WO | WO-2017036816 | A1 | * | 3/2017 | ..... C25D 3/38 |
| WO | WO 2017/121657 | A1 | | 7/2017 | |

OTHER PUBLICATIONS

Extended European Search Report dated Nov. 15, 2017 in Patent Application No. 17173987.3, 3 pages.

International Preliminary Report on Patentability and Written Opinion of the International Searching Authority dated Dec. 3, 2019 in PCT/EP2018/063889 filed Mar. 28, 2018, 12 pages.

International Search Report dated Jul. 4, 2018 in PCT/EP2018/063889 filed on May 28, 2018, 4 pages.

* cited by examiner

COMPOSITION FOR TIN OR TIN ALLOY ELECTROPLATING COMPRISING LEVELING AGENT

BACKGROUND OF THE INVENTION

The invention relates to tin or tin alloy electroplating compositions comprising a leveling agent, their use and processes for tin or tin alloy electroplating.

Metals and metal-alloys are commercially important, particularly in the electronics industry where they are often used as electrical contacts, final finishes and solders. Lead-free solders, such as tin, tin-silver, tin-copper, tin-bismuth, tin-silver-copper, and others, are common metals used in solders. These solders are often deposited on semiconductor substrates by means of metal electroplating plating baths.

A typical tin plating solution comprises dissolved tin ions, water, an acid electrolyte such as methanesulfonic acid in an amount sufficient to impart conductivity to the bath, an antioxidant, and proprietary additives to improve the uniformity of the plating and the quality of the metal deposit in terms of surface roughness and void formation. Such additives usually include surfactants and grain refiners, among others.

Certain applications for lead-free solder plating present challenges in the electronics industry. For example, when used as a capping layer on copper pillars, a relatively small amount of lead-free solder, such as tin-silver solder, is deposited on top of a copper pillar. In plating such small amounts of solder it is often difficult to plate a uniform height of solder composition on top of each pillar, both within a die and across the wafer. The use of known solder electroplating baths also results in deposits having a relatively rough surface morphology.

U.S. Pat. No. 3,577,328 discloses a tin electroplating composition comprising, besides tin and sulfate, imidazoline derivatives as surface active agent optionally in combination with condensates of an alkyl phenol with an alkylene oxide.

U.S. Pat. No. 7,357,853 B2 discloses a composition and method of selectively electroplating a tin or tin alloy on a composite substrate having metallic portions and ceramic portions without loss of adhesion between the metal and ceramic portions. Such compositions may also contain imidazolium compounds, such as coconut oil substituted carboxylated imidazoline.

U.S. Pat. No. 8,083,922 B2 relates to a tin electrolytic plating method using a tin electrolytic plating solution which comprises a nonionic surfactant either alone, or with a suitably selected cationic surfactant and/or a suitably selected alkyl imidazole.

US 2012/0132530 A1 relates to a tin plating solution including a tin ion source, at least one nonionic surfactant, imidazoline dicarboxylate and 1,10-phenanthroline.

US 2013/068626 A relates to a metal, particularly copper electroplating composition comprising a polyimidazolium leveler compound and its use for interconnect electroplating. Tin and copper-tin alloys having up to about 2 percent by weight tin are mentioned.

JP 09-272995 A discloses a tin or tin-lead alloy electroplating composition which may contain besides a complexing agent and an alkali and/or alkaline earth metal ion and ammonium and/or organic amine ion in a molar ratio of 1/5 to 5/1, a polyimidazolium derivative. The alkaline bath is intended for electroplating parts which are subject to corrosion when using acidic compositions, such as ceramic component modules.

However, there is still interest in the electronic industry for a pure tin or tin-alloy electroplating bath which leads to solder deposit with a reduced roughness in combination with an improved uniformity in height, also called coplanarity (COP).

It is an object of the present invention to provide a tin or tin alloy electroplating additive having good leveling properties, in particular leveling agents capable of providing a substantially planar tin or tin alloy layer and filling features on the micrometer scale without substantially forming defects, such as but not limited to voids, with a tin or tin alloy electroplating bath. It is further an object of the invention to provide a tin or tin alloy electroplating bath that provides a uniform and planar tin or tin alloy deposit, in particular in features of 1 micrometer to 200 micrometer width.

SUMMARY OF THE INVENTION

The present invention provides an aqueous composition comprising tin ions, optionally further alloy metal ions selected from silver, indium, and bismuth ions and at least one additive comprising a linear or branched polyimidazolium compound comprising the structural unit of formula L1

(L1)

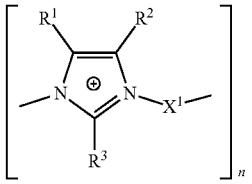

wherein $R^1$, $R^2$, $R^3$ are each independently selected from an H atom and an organic radical having from 1 to 20 carbon atoms, $X^1$ is selected from (a) a linear, branched or cyclic $C_4$ to $C_{20}$ alkanediyl, which may be unsubstituted or substituted, which may optionally be interrupted by O, S and $NR^{10}$ and substituted by aryl groups, and may comprise one or more continuations of the imidazolium compound by branching, and (b) a group $Y^2$—$Y^1$—$Y^2$, with the proviso that $X^1$ does not comprise a hydroxyl group in the α or β positions relative to the nitrogen atoms of the imidazole rings, $Y^1$ is a $C_5$ to $C_{12}$ carbocyclic or heterocyclic aromatic moiety, which may comprise one or more continuations of the imidazolium compound by branching, $Y^2$ is independently selected from a linear or branched $C_1$ to $C_6$ alkanediyl, which may optionally be interrupted by O, S and $NR^{10}$ and substituted by aryl groups, and which may comprise one or more continuations of the imidazolium compound by branching, $R^{10}$ is H or a $C_1$ to $C_6$ alkyl, n is an integer from 2 to 5000.

A further embodiment of the present invention is the use of the imidazolium additives as described herein in a bath for depositing tin alloy containing layers wherein the tin alloy containing layers comprise an alloy metal selected from silver, copper, indium, and bismuth in an amount of 0.01 to 10% by weight.

Yet another embodiment of the present invention is a process for depositing tin alloy layer on a substrate by a) contacting a tin alloy electroplating bath comprising a composition as described herein with the substrate, and
b) applying a current density to the substrate for a time sufficient to deposit a tin alloy layer onto the substrate, wherein the alloy metal content of the deposited tin alloy is 0.01 to 10% by weight.

The agents/additives according to the present invention can advantageously be used in bonding technologies such as the manufacture of tin or tin alloy bumps of typically 1 to 200, preferably 3 to 100, most preferably 5 to 50 micrometers height and width for the bumping process, in circuit board technologies or in packaging processes for electronic circuits. In one particular embodiment, the substrate comprises micrometer sized features and the deposition is performed to fill the micrometer sized features, wherein the micrometer-sized features have a size from 1 to 200 micrometers, preferably 3 to 100 micrometers.

DETAILED DESCRIPTION OF THE INVENTION

Levelers According to the Invention

Figure 1:
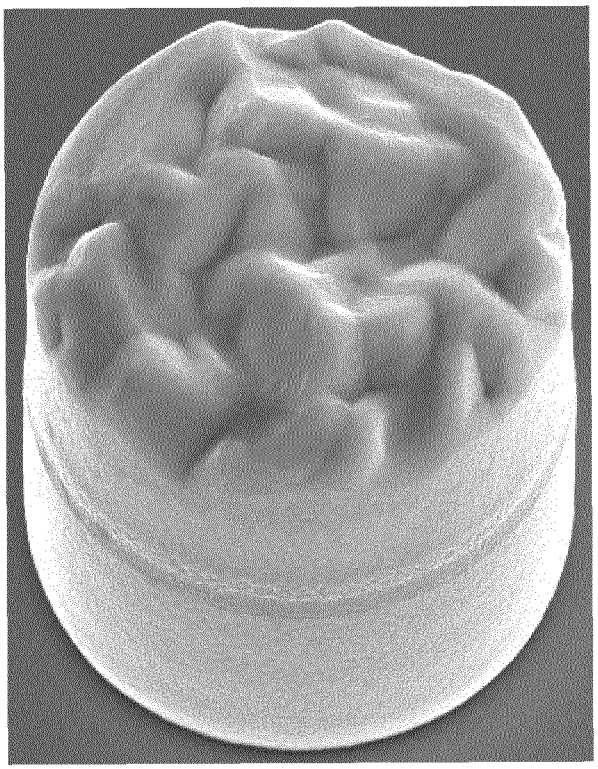
FIG. 1 shows a SEM image of a tin bump electroplated according to Comparative Example 2.1.

In the following, the terms "leveler", "imidazolium compound", and "polyimidazolium compound" are used herein synonymously.

Generally, $R^1$ and $R^2$ may be an H atom or an organic radical having from 1 to 20 carbon atoms. The radicals can be branched or unbranched or comprise functional groups which can, for example, contribute to further crosslinking of the polymeric imidazolium compound. Preferably, $R^1$ and $R^2$ are each, independently of one another, hydrogen atoms or hydrocarbon radicals having from 1 to 6 carbon atoms. Most preferably $R^1$ and $R^2$ are H atoms.

Generally, $R^3$ may be an H atom or an organic radical having from 1 to 20 carbon atoms. Preferably, $R^3$ is an H atom or methyl, ethyl or propyl. Most preferably $R^3$ is an H atom.

Generally, $X^1$ may be a linear, branched or cyclic aliphatic diradical selected from a $C_4$ to $C_{20}$ alkandiyl, which may comprise one or more continuations of the imidazolium compound by branching.

As used herein, "continuation of the polyimidazolium compound by branching" means that the respective spacer group $X^1$ comprises one or more, preferably one or two, groups from which a polyimidazole branch is started. Preferably, $X^1$ does not comprise any continuation of the polyimidazolium compound by branching, i.e. the polyimidazolium compound is a linear polymer.

In a first embodiment $X^1$ is $C_4$ to $C_{14}$ alkanediyl, most preferably $C_4$ to $C_{12}$ alkanediyl, which may be unsubstituted or substituted, particularly by $OR^4$, $NR^4{}_2$, and $SR^4$, in which $R^4$ is a $C_1$ to $C_4$ alkyl group. Optionally, $X^1$ may be interrupted by O, S and $NR^{10}$ and substituted by aryl groups, and may comprise one or more continuations of the imidazolium compound by branching. In a particular embodiment, $X^1$ is a pure hydrocarbon radical which does not comprise any functional groups.

Particularly preferred groups $X^1$ are selected from a linear or branched butanediyl, pentanediyl, hexanediyl, heptanediyl, octanediyl, nonanediyl, decanediyl, undecanediyl, and dodecanediyl, which may be unsubstituted or substituted by $OR^4$, $NR^4$. Particularly preferred groups $X^1$ are selected from linear butanediyl, hexanediyl and octanediyl.

In second embodiment, group $X^1$ may be a cyclic alkanediyl of formula

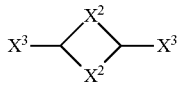

wherein $X^2$ is independently selected from a $C_1$ to $C_4$ alkanediyl, which may be interrupted by one or two selected from O and $NR^4$, and $X^3$ is independently selected from (a) a chemical bond or (b) a $C_1$ to $C_4$ alkanediyl, which may be interrupted by O or $NR^4$, wherein $R^4$ is a $C_1$ to $C_4$ alkyl group.

As used herein, "chemical bond" means that the respective moiety is not present but that the adjacent moieties are bridged so as to form a direct chemical bond between these adjacent moieties. By way of example, if in X—Y—Z the moiety Y is a chemical bond then the adjacent moieties X and Z together form a group X—Z.

Either $X^2$ or $X^3$ or both $X^2$ and $X^3$ may comprise one or more continuations of the imidazolium compound by branching, preferably only $X^2$ may comprise such continuations of the imidazolium compound by branching.

In this second embodiment, most preferably one $X^2$ is selected from methanediyl and the other $X^2$ is selected from propanediyl or both $X^2$ are selected from ethanediyl. Particularly preferred are groups $X^1$ are selected from isophoronediamine, biscyclohexyldiamino methane, and methyl-cyclohexyl-diamine (MDACH).

In a third embodiment, $X^1$ may be a (hetero)arylalkyl diradical selected from $Y^2$—$Y^1$—$Y^2$. Herein $Y^1$ may be a $C_5$ to $C_{20}$ aryl group and $Y^2$ may be independently selected from a linear or branched $C_1$ to $C_6$ alkanediyl. Also here, both, $Y^1$ and $Y^2$ may comprise one or more continuations of the imidazolium compound by branching.

Preferred groups $Y^1$ are selected from phenyl, naphtyl, pyridyl, pyrimidyl, and furanyl, most preferably phenyl. Preferred groups $Y^2$ are selected from a linear or branched $C_1$ to $C_4$ alkanediyl, preferably from methanediyl, ethanediyl, 1,3-propanediyl and 1,4-butanediyl.

The organic radical $X^1$ may comprise not only carbon and hydrogen but also heteroatoms such as oxygen, nitrogen, sulfur or halogens, e.g. in the form of functional groups such as hydroxyl groups, ether groups, amide groups, aromatic heterocycles, primary, secondary, or tertiary amino groups or imino groups.

In particular, the organic radical $X^1$ may be a hydrocarbon diradical which may be substituted or interrupted by functional groups comprising heteroatoms, in particular ether groups. If substituted, it is preferred that $X^1$ does not comprise any hydroxyl groups.

n may generally be an integer from 2 to about 5000, preferably from about 5 to about 3000, even more preferably from about 8 to about 1000, even more preferably from about 10 to about 300, even more preferably from about 15 to about 250, most preferably from about 25 to about 150.

The mass average molecular weight $M_w$ of the additive may generally be from 500 g/mol to 1,000,000 g/mol, preferably from 1000 g/mol to 500,000 g/mol, more preferably from 1500 g/mol to 100,000 g/mol, even more preferably from 2,000 g/mol to 50,000 g/mol, even more preferably from 3,000 g/mol to 40,000 g/mol, most preferably from 5,000 g/mol to 25,000 g/mol.

Preferably the at least one additive comprises a counterion $Y^{o-}$, wherein o is a positive integer selected so that the overall additive is electrically neutral. Preferably o is 1, 2 or 3. Most preferably, the counterion $Y^{o-}$ is selected from chloride, sulfate, methanesulfonate or acetate.

Preferably the number average molecular weight $M_n$ of the polymeric imidazolium compound, determined by gel permeation chromatography, is be greater than 500 g/mol.

Preferably the polymeric imidazolium compound may comprise more than 80% by weight of structural units of the formula L1.

Preferably, the composition according to the present invention is prepared by reacting an α-dicarbonyl compound $R^1$—CO—CO—$R^2$, an aldehyde $R^3$—CHO, at least one amino compound $(NH_2—)_mX^1$ protic acid $(H^+)_oY^{o-}$, wherein $R^1$, $R^2$, $R^3$, $X^1$, Y, and o have the prescribed meanings.

Herein, the amino compound is an aliphatic or aromatic diamine, triamine, multiamin with more than 3 amino groups, or a mixture thereof.

As used herein, "feature" refers to recesses or openings in a substrate, such as, but not limited to, recesses in a developed photoresist where the bump metal is to be plated in. "Deposition" and "plating" are used interchangeably throughout this specification. The term "alkyl" means $C_1$ to $C_{30}$ alkyl and includes linear, branched and cyclic alkyl, wherein x in $C_x$ indicates the number of carbon atoms. "Substituted alkyl" means that one or more of the hydrogens on the alkyl group is replaced with another substituent group, such as, but not limited to, cyano, hydroxy, halo, $(C_1$-$C_6)$alkoxy, $(C_1$-$C_6)$alkylthio, thiol, nitro, and the like. As used herein "aryl" includes carbocyclic and heterocyclic aromatic systems. By "substituted aryl" is meant that one or more hydrogens on the aryl ring are replaced with one or more substituent groups, such as, but not limited to, cyano, hydroxy, halo, $(C_1$-$C_6)$alkoxy, $(C_1$-$C_6)$alkyl, $(C_2$-$C_6)$alkenyl, $(C_1$-$C_6)$alkylthio, thiol, nitro, and the like. As used herein "polymer" or "polymeric" generally means any compound comprising at least two monomeric units i.e. the term polymer includes dimers, trimers, etc., oligomers as well as high molecular weight polymers.

The additives according to the present invention may be prepared by any preparation method.

A preferred process for preparation is performed by reacting (a) an α-dicarbonyl compound, (b) an aldehyde, (c) at least one amino compound having at least two primary amino groups and (d) a protic acid with one another as described in the unpublished International patent application No. PCT/EP2009/066781 which is hereby incorporated by reference. The above compounds are defined by their content of functional groups. It is also possible, for example, for two of the above compounds to be identical when, for example, a compound comprises both an acid function and, for example, two primary amino groups or an aldehyde group. The reaction is a polycondensation. In a polycondensation, polymerization occurs with elimination of a low molecular weight compound such as water or alcohol.

In the present case, water is eliminated. When the carbonyl groups of the α-dicarbonyl compound are present completely or partly as ketal and/or the aldehyde group of the aldehyde is present as acetal or hemiacetal, an alcohol is correspondingly eliminated instead of water.

The α-dicarbonyl compound (a) is preferably a compound of the formula L2a $$R^1—CO—CO—R^2 \quad \text{(L2a)}$$

The compound is particularly preferably glyoxal.

The carbonyl groups of the α-dicarbonyl compound can also be present as ketal or hemiketal, preferably as hemiketal or ketal of a lower alcohol, e.g. a $C_1$-$C_{10}$-alkanol. In this case, the alcohol is eliminated in the later condensation reaction.

The carbonyl groups of the α-dicarbonyl compound are preferably not present as hemiketal or ketal.

The aldehyde compound (b) may be any compound having at least one aldehyde group. The aldehyde is in particular an aldehyde of the formula L2b $$R^3—CHO \quad \text{(L2b)}$$

The aldehyde group of the aldehyde can also be present as hemiacetal or acetal, preferably as hemiacetal or acetal of a lower alcohol, e.g. a C1-C10-alkanol. In this case, the alcohol is eliminated in the later condensation reaction.

The aldehyde group is preferably not present as hemiacetal or acetal.

The amino compound (c) is a compound having at least two primary amino groups.

The amino compound can be represented by the general formula L2c $$(NH_2—)_mX^1 \quad \text{(L2c)}$$

wherein m is an integer greater than or equal to 2 and indicates the number of amino groups. m can be very large values, e.g. m can be an integer from 2 to 10000, in particular from 2 to 5000. Very high values of m are present, for example, when polyamines such as polyvinylamine or polyethylenimine are used.

When compounds having m=2 (diamines) are used in the reaction, linear, polymeric imidazolium compounds are formed, while in the case of amines having more than two primary amino groups, branched polymers are formed. In the latter case the polyimidazolium compounds of formula L1 have group $X^1$ that comprises a continuation of the polyimidazolium compound by branching.

In a preferred embodiment, m is an integer from 2 to 6, in particular from 2 to 4. Very particular preference is given to m=2 (diamine) or m=3 (triamine). Very particular preference is given to m=2.

In a preferred embodiment, the amino compound comprises at most ether groups, secondary or tertiary amino groups and apart from these no further functional groups. Mention may be made of, for example, polyether amines. $X^1$ is therefore preferably a pure hydrocarbon radical or a hydrocarbon radical interrupted or substituted by ether groups, secondary amino groups or tertiary amino groups. In a particular embodiment, $X^1$ is a pure hydrocarbon radical and does not comprise any functional groups.

The hydrocarbon radical can be aliphatic or aromatic or comprise both aromatic and aliphatic groups.

Possible amino compounds are amino compounds, preferably diamines, in which the primary amino groups are bound to an aliphatic hydrocarbon radical, preferably an aliphatic hydrocarbon radical having from 2 to 50 carbon atoms, particularly preferably from 3 to 40 carbon atoms.

Further possible amino compounds are amino compounds, preferably diamines, in which the primary amino groups are bound directly to an aromatic ring system, e.g. a phenylene or naphthylene group, or amino compounds in which the primary amino groups are bound to aliphatic groups as alkyl substituents of an aromatic ring system.

Diamines which may be mentioned are, in particular, $C_2$-$C_{20}$-alkylenediamines such as 1,4-butylenediamine or 1,6-hexylenediamine.

Possible triamines are, for example, aliphatic compounds of the formula L2d

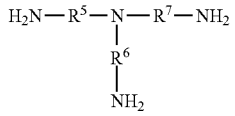

(L2d)

where $R^5$, $R^6$ and $R^7$ are each, independently of one another, a $C_1$-$C_{10}$ alkylene group, particularly preferably a $C_2$-$C_6$-alkylene group.

In the simplest case, the radicals $R^5$, $R^6$ and $R^7$ have the same meaning; an example which may be mentioned is triaminoethylamine ($R^5$=$R^6$=$R^7$=ethandiyl).

Compounds having the following structures may also be used:

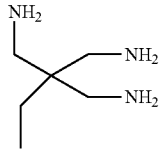

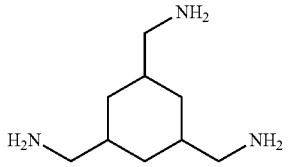

It is also possible to use, in particular, mixtures of amino compounds in the process of the invention. In this way, polymeric imidazolium compounds which comprise different molecular groups between the imidazole rings are obtained. The use of such mixtures makes it possible to set desired properties such as leveling efficiency in a targeted way.

As mixtures of amino compounds, it is possible to use, for example, mixtures of various aliphatic amino compounds or mixtures of various aromatic amino compounds and also mixtures of aliphatic and aromatic amino compounds. The amino compounds in the mixtures can be amino compounds having different numbers of primary amino groups. When diamines are used in the process of the invention, linear polymers are obtained. When amino compounds having three or more primary amino groups are used, crosslinked and/or branched structures are formed. The use of diamines in admixture with amino compounds having more than two primary amino groups, e.g. triamines, enables the desired degree of crosslinking or degree of branching to be set via the proportion of triamines.

Amino compounds having a hydroxyl group in the R position relative to one of the primary amino groups can also be used as amino compounds. In this case, polymeric imidazolium compounds which have been able to be obtained according to the prior art by reaction of imidazole derivatives with epichlorohydrin or other epoxy compounds (see above) can also be obtained by the process of the invention. However, the use of such compounds is not absolutely necessary for the purposes of the invention, so that it can also be dispensed with.

In a preferred embodiment, the amino compound has a molecular weight of less than 10000 g/mol, particularly preferably less than 5000 g/mol, very particularly preferably less than 1000 g/mol, in most preferably less than 500 g/mol.

Possible diamines and triamines are, in particular, compounds having a molecular weight of from 60 to 500 g/mol or from 60 to 250 g/mol.

In the process of preparing the additives according to the invention, it is possible to use further compounds, e.g. in order to introduce specific end groups into the polymer or bring about additional crosslinking by means of further functional groups, to set defined properties or to make further reactions on the resulting polymer (polymer-analogous reactions) at a later point in time possible.

Thus, if desired, it is possible to make concomitant use of, for example, compounds having only one primary amino group in order to influence the molecular weight of the polymeric imidazolium compounds. The compound having only one primary amino group leads to chain termination and then forms the end group of the polymer chain concerned. The higher the proportion of compounds having only one primary amino group, the lower the molecular weight. Based on 100 mol of amino compounds having at least two primary amino groups, it is possible, in a preferred embodiment, to use, for example, from 0 to 10 mol of compounds having only one primary group.

The protic acid (d) can be represented by the formula $Y^{o-}(H^+)_o$, where o is an integer. It can also be a polymeric protic acid, e.g. polyacrylic acid; in this case, o may be very high values. As such polymeric protic acids, mention may be made of, for example, polyacrylic acid, polymethacrylic acid or a copolymer of (meth)acrylic acid, maleic acid, fumaric acid or itaconic acid with any other monomers, e.g. with (meth)acrylates, vinyl esters or aromatic monomers such as styrene, or another polymer having a plurality of carboxyl groups.

In a preferred embodiment, o is an integer from 1 to 4, particularly preferably 1 or 2. In a particular embodiment, o is 1.

The anion $Y^{o-}$ of the protic acid forms the counterion to the imidazolium cations of the polymeric imidazolium compound.

The anion of the protic acid is, for example, selected from $F^-$, $Cl^-$, $NO_2^-$, $NO_3^-$, the group of sulfates, sulfites and sulfonates, e.g. $SO_4^{2-}$, $HSO_4^-$, $SO_3^{2-}$, $HSO_3^-$, $H_3COSO_3^-$, $H_3CSO_3^-$, phenylsulfonate, p-tolylsulfonate, $HCO_3^-$, $CO_3^{2-}$, the group of alkoxides and aryloxides, e.g. $H_3CO^-$, $H_5C_2O^-$, the group of phosphates, phosphonates, phosphinates, phosphites, phosphonites and phosphinites, e.g. $PO_4^{3-}$, $HPO_4^{2-}$, $H_2PO_4^-$, $PO_3^{3-}$, $HPO_3^{2-}$, $H_2PO_3^-$, the group of carboxylates, e.g. formiate and acetate, and the group of halogenated hydrocarbons, e.g. $CF_3SO_3^-$, $(CF_3SO_3)_2N^-$, $CF_3CO_2$ and $CCl_3CO_2^-$ The products received in this way may be subjected to a typical anion exchange by means of precipitation or by anion exchange resins to receive a desired counter-ion.

The reaction of the starting compounds is preferably carried out in water, a water-miscible solvent or mixtures thereof.

Water-miscible solvents are, in particular, protic solvents, preferably aliphatic alcohols or ethers having not more than 4 carbon atoms, e.g. methanol, ethanol, methyl ethyl ether, tetrahydrofuran. Suitable protic solvents are miscible with water in any ratio (at 1 bar, 21° C.).

The reaction is preferably carried out in water or mixtures of water with the above protic solvents. The reaction is particularly preferably carried out in water.

The reaction of the starting components can be carried out at, for example, pressures of from 0.1 to 10 bar, in particular atmospheric pressure. The reaction of the starting components can be carried out, for example, at temperatures of from 5 to 120° C. In particular, the starting components are added at about 5 to 50, preferably 15 to 30° C., followed by heating up to 120° C., preferably 80 to 100° C.

The starting components can be combined in any order.

The reaction can be carried out batchwise, semicontinuously or continuously. In the semicontinuous mode of operation, it is possible, for example, for at least one starting compound to be initially charged and the other starting components to be metered in.

In the continuous mode of operation, the starting components are combined continuously and the product mixture is discharged continuously. The starting components can be fed in either individually or as a mixture of all or part of the starting components. In a particular embodiment, the amine and the acid are mixed beforehand and fed in as one stream, while the other components can be fed in either individually or likewise as a mixture (2nd stream).

In a further particular embodiment, all starting components comprising carbonyl groups (i.e. the α-dicarbonyl compound, the aldehyde and the protic acid of the anion X if the latter is a carboxylate) are mixed beforehand and fed in together as a stream; the remaining amino compound is then fed in separately.

The continuous preparation can be carried out in any reaction vessels, i.e. in a stirred vessel. It is preferably carried out in a cascade of stirred vessels, e.g. from 2 to 4 stirred vessels, or in a tube reactor.

The reaction proceeds in principle according to the following reaction equation.

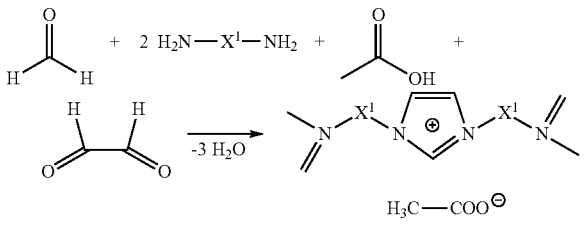

Instead of $CH_3COO^-$ any other anion mentioned above may be used or $CH_3COO^-$ may be subjected to anion exchange by means of precipitation or by anion exchange resins to get a desired counter-ion.

Here, 1 mol of aldehyde, 2 mol of primary amino groups and 1 mol of acid group ($H^+$) of the protic acid are required per 1 mol of α-dicarbonyl compound. In the polymer obtained, the imidazolium groups are joined to one another by the diamine.

More details and alternatives are described in patent publication WO 2016/020216 and International Patent Application No. PCT/EP2017/050054, respectively, which are incorporated herein by reference.

It will be appreciated by those skilled in the art that more than one leveling agent may be used. When two or more leveling agents are used, at least one of the leveling agents is a polyimidazolium compound or a derivative thereof as described herein. It is preferred to use only one or more polyimidazolium compound as leveling agents in the plating bath composition.

Suitable additional leveling agents include, but are not limited to, polyaminoamide and derivatives thereof, polyalkanolamine and derivatives thereof, polyethylene imine and derivatives thereof, quaternized polyethylene imine, polyglycine, poly(allylamine), polyaniline, polyurea, polyacrylamide, poly(melamine-co-formaldehyde), reaction products of amines with epichlorohydrin, reaction products of an amine, epichlorohydrin, and polyalkylene oxide, reaction products of an amine with a polyepoxide, polyvinylpyridine, polyvinylimidazole, polyvinylpyrrolidone, or copolymers thereof, nigrosines, pentamethyl-para-rosaniline hydrohalide, hexamethyl-pararosaniline hydrohalide, or compounds containing a functional group of the formula N—R—S, where R is a substituted alkyl, unsubstituted alkyl, substituted aryl or unsubstituted aryl. Typically, the alkyl groups are $C_1$-$C_6$ alkyl and preferably $C_1$-$C_4$ alkyl. In general, the aryl groups include $C_6$-$C_{20}$ aryl, preferably $C_6$-$C_{12}$ aryl. Such aryl groups may further include heteroatoms, such as sulfur, nitrogen and oxygen. It is preferred that the aryl group is phenyl or napthyl. The compounds containing a functional group of the formula N—R—S are generally known, are generally commercially available and may be used without further purification.

In such compounds containing the N—R—S functional group, the sulfur ("S") and/or the nitrogen ("N") may be attached to such compounds with single or double bonds. When the sulfur is attached to such compounds with a single bond, the sulfur will have another substituent group, such as but not limited to hydrogen, $C_1$-$C_{12}$ alkyl, $C_2$-$C_{12}$ alkenyl, $C_6$-$C_{20}$ aryl, $C_1$-$C_{12}$ alkylthio, $C_2$-$C_{12}$ alkenylthio, $C_6$-$C_{20}$ arylthio and the like. Likewise, the nitrogen will have one or more substituent groups, such as but not limited to hydrogen, $C_1$-$C_{12}$ alkyl, $C_2$-$C_{12}$ alkenyl, $C_7$-$C_{10}$ aryl, and the like. The N—R—S functional group may be acyclic or cyclic. Compounds containing cyclic N—R—S functional groups include those having either the nitrogen or the sulfur or both the nitrogen and the sulfur within the ring system.

Further leveling agents are triethanolamine condensates as described in unpublished international Patent Application No. PCT/EP2009/066581.

In general, the total amount of leveling agents in the electroplating bath is from 0.5 ppm to 10000 ppm based on the total weight of the plating bath. The leveling agents according to the present invention are typically used in a total amount of from about 100 ppm to about 10000 ppm based on the total weight of the plating bath, although greater or lesser amounts may be used.

A large variety of additives may typically be used in the bath to provide desired surface finishes for the plated tin or tin alloy bump. Usually more than one additive is used with each additive forming a desired function. Advantageously, the electroplating baths may contain one or more of surfactants, grain refiners, complexing agents in case of alloy deposition, antioxidants, and mixtures thereof. Most preferably the electroplating bath comprises a surfactant and optionally a grain refiner in addition to the leveling agent according to the present invention. Other additives may also be suitably used in the present electroplating baths.

Surfactants

One or more nonionic surfactants may be used in the present compositions. Typically, the nonionic surfactants have an average molecular weight from 200 to 100,000, preferably from 500 to 50,000, more preferably from 500 to 25,000, and yet more preferably from 750 to 15,000. Such nonionic surfactants are typically present in the electrolyte compositions in a concentration from 1 to 10,000 ppm, based on the weight of the composition, and preferably from 5 to 10,000 ppm. Preferred alkylene oxide compounds include polyalkylene glycols, such as but not limited to alkylene oxide addition products of an organic compound having at least one hydroxy group and 20 carbon atoms or less and tetrafunctional polyethers derived from the addition of different alkylene oxides to low molecular weight polyamine compounds.

Preferred polyalkylene glycols are polyethylene glycol and polypropylene glycol. Such polyalkylene glycols are generally commercially available from a variety of sources and may be used without further purification. Capped polyalkylene glycols where one or more of the terminal hydrogens are replaced with a hydrocarbyl group may also be suitably used. Examples of suitable polyalkylene glycols are those of the formula R—O—$(CXYCX'Y'O)_n$R' where R and R' are independently chosen from H, $C_2$-$C_{20}$ alkyl group and $C_6$-$C_{20}$ aryl group; each of X, Y, X' and Y' is independently selected from hydrogen, alkyl such as methyl, ethyl or propyl, aryl such as phenyl, or aralkyl such as benzyl; and n is an integer from 5 to 100,000. Typically, one or more of X, Y, X' and Y' is hydrogen.

Suitable EO/PO copolymers generally have a weight ratio of EO:PO of from 10:90 to 90:10, and preferably from 10:90 to 80:20. Such EO/PO copolymers preferably have an average molecular weight of from 750 to 15,000. Such EO/PO copolymers are available from a variety of sources, such as those available from BASF under the tradename "PLURONIC".

Suitable alkylene oxide condensation products of an organic compound having at least one hydroxy group and 20 carbon atoms or less include those having an aliphatic hydrocarbon from one to seven carbon atoms, an unsubstituted aromatic compound or an alkylated aromatic compound having six carbons or less in the alkyl moiety, such as those disclosed in U.S. Pat. No. 5,174,887. The aliphatic alcohols may be saturated or unsaturated. Suitable aromatic compounds are those having up to two aromatic rings. The aromatic alcohols have up to 20 carbon atoms prior to derivatization with ethylene oxide. Such aliphatic and aromatic alcohols may be further substituted, such as with sulfate or sulfonate groups.

Grain Refiners

The tin or tin alloy electroplating bath may further contain grain refiners. Grain refiners may be chosen from a compound of formula G1 or G2

(G1)

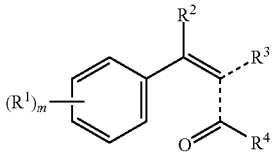

-continued (G2)

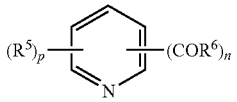

wherein each $R^1$ is independently $C_1$ to $C_6$ alkyl, $C_1$ to $C_6$ alkoxy, hydroxy, or halogen; $R^2$ and $R^3$ are independently selected from H and $C_1$ to $C_6$ alkyl; $R^4$ is H, OH, $C_1$ to $C_6$ alkyl or $C_1$ to $C_6$ alkoxy; m is an integer from 0 to 2; each $R^5$ is independently $C_1$ to $C_6$ alkyl; each $R^6$ is independently chosen from H, OH, $C_1$ to $C_6$ alkyl, or $C_1$ $C_6$ alkoxy; n is 1 or 2; and p is 0, 1 or 2.

Preferably, each $R^1$ is independently $C_1$ to $C_6$ alkyl, $C_1$ to $C_3$ alkoxy, or hydroxy, and more preferably $C_1$ to $C_4$ alkyl, $C_1$ to $C_2$ alkoxy, or hydroxy. It is preferred that $R^2$ and $R^3$ are independently chosen from H and $C_1$ to $C_3$ alkyl, and more preferably H and methyl. Preferably, $R^4$ is H, OH, $C^1$ to $C^4$ alkyl or $C_1$ to $C_4$ alkoxy, and more preferably H, OH, or $C_1$ to $C_4$ alkyl. It is preferred that $R^5$ is $C_1$ to $C_4$ alkyl, and more preferably $C_1$ to $C_3$ alkyl. Each $R^6$ is preferably chosen from H, OH, or $C_1$ to $C_6$ alkyl, more preferably H, OH, or $C_1$ to $C_3$ alkyl, and yet more preferably H or OH. It is preferred that m is 0 or 1, and more preferably m is 0. Preferably, n is 1. It is preferred that p is 0 or 1, and more preferably p is 0. A mixture of first grain refiners may be used, such as two different grain refiners of formula 1, 2 different grain refiners of formula 2, or a mixture of a grain refiner of formula 1 and a grain refiner of formula 2.

Exemplary compounds useful as such grain refiners include, but are not limited to, cinnamic acid, cinnamaldehyde, benzylidene acetone, picolinic acid, pyridinedicarboxylic acid, pyridinecarboxaldehyde, pyridinedicarboxaldehyde, or mixtures thereof. Preferred grain refiners include benzalacetone, 4-methoxy benzaldehyde, benzylpyridin-3-carboxylate, and 1,10-phenantroline.

Further grain refiners may be chosen from an α,β-unsaturated aliphatic carbonyl compound. Suitable α,β-unsaturated aliphatic carbonyl compound include, but are not limited to, α,β-unsaturated carboxylic acids, α,β-unsaturated carboxylic acid esters, α,β-unsaturated amides, and α,β-unsaturated aldehydes. Preferably, such grain refiners are chosen from α,β-unsaturated carboxylic acids, α,β-unsaturated carboxylic acid esters, and α,β-unsaturated aldehydes, and more preferably α,β-unsaturated carboxylic acids, and α,β-unsaturated aldehydes. Exemplary α,β-unsaturated aliphatic carbonyl compounds include (meth) acrylic acid, crotonic acid, C to C6 alkyl meth)acrylate, (meth)acrylamide, $C_1$ to $C_6$ alkyl crotonate, crotonamide, crotonaldehyde, (meth)acrolein, or mixtures thereof. Preferred α,β-unsaturated aliphatic carbonyl compounds are (meth)acrylic acid, crotonic acid, crotonaldehyde, (meth) acrylaldehyde or mixtures thereof.

Grain refiners may be present in the plating baths of the invention in an amount of 0.0001 to 0.045 g/l. Preferably, the grain refiners are present in an amount of 0.0001 to 0.04 g/l, more preferably in an amount of 0.0001 to 0.035 g/l, and yet more preferably from 0.0001 to 0.03 g/l. Compounds useful as the first grain refiners are generally commercially available from a variety of sources and may be used as is or may be further purified.

The present compositions may optionally include further additives, such as antioxidants, organic solvents, complexing agents, and mixtures thereof. While additional levelers may be used in the present plating baths, it is preferred that the plating baths comprise only the levelers according to the present invention.

Antioxidants

Antioxidants may optionally be added to the present composition to assist in keeping the tin in a soluble, divalent state. It is preferred that one or more antioxidants are used in the present compositions. Exemplary antioxidants include, but are not limited to, hydroquinone, and hydroxylated and/or alkoxylated aromatic compounds, including sulfonic acid derivatives of such aromatic compounds, and preferably are: hydroquinone; methylhydroquinone; resorcinol; catechol; 1,2,3-trihydroxybenzene; 1,2-dihydroxybenzene-4-sulfonic acid; 1,2-dihydroxy-benzene-3,5-disulfonic acid; 1,4-dihydroxybenzene-2-sulfonic acid; 1,4-dihydroxybenzene-2,5-disulfonic acid; 2,4-dihyroxybenzene sulfonic acid, and p-Methoxyphenol. Such antioxidants are disclosed in U.S. Pat. No. 4,871,429. Other suitable antioxidants or reducing agents include, but are not limited to, vanadium compounds, such as vanadylacetylacetonate, vanadium triacetylacetonate, vanadium halides, vanadium oxyhalides, vanadium alkoxides and vanadyl alkoxides. The concentration of such reducing agent is well known to those skilled in the art, but is typically in the range of from 0.1 to 10 g/l, and preferably from 1 to 5 g/l. Such antioxidants are generally commercially available from a variety of sources. It is particularly preferred to use the prescribed antioxidants in pure tin electroplating compositions.

Complexing Agents

The tin or tin alloy electroplating bath may further contain complexing agents for complexing tin and/or any other metal present in the composition. A typical complexing agent is 3,6-Dithia-1,8-octanediol.

Typical complexing agents are polyoxy monocarboxylic acids, polycarboxylic acids, aminocarboxylic acids, lactone compounds, and salts thereof.

Other complexing agents are organic thiocompounds like thiourea, thiols or thioethers as disclosed in U.S. Pat. No. 7,628,903, JP 4296358 B2, EP 0854206 A and U.S. Pat. No. 8,980,077 B2.

Electrolyte

In general, as used herein "aqueous" means that the present electroplating compositions comprises a solvent comprising at least 50% of water. Preferably, "aqueous" means that the major part of the composition is water, more preferably 90% of the solvent is water, most preferably the solvent essentially consists of water. Any type of water may be used, such as distilled, deionized or tap.

Tin

The tin ion source may be any compound capable of releasing metal ions to be deposited in the electroplating bath in sufficient amount, i.e is at least partially soluble in the electroplating bath. It is preferred that the metal ion source is soluble in the plating bath. Suitable metal ion sources are metal salts and include, but are not limited to, metal sulfates, metal halides, metal acetates, metal nitrates, metal fluoroborates, metal alkylsulfonates, metal arylsulfonates, metal sulfamates, metal gluconates and the like.

The metal ion source may be used in the present invention in any amount that provides sufficient metal ions for electroplating on a substrate. When the metal is solely tin, the tin salt is typically present in an amount in the range of from about 1 to about 300 g/l of plating solution.

Alloying Metals

Optionally, the plating baths according to the invention may contain one or more alloying metal ions. Suitable alloying metals include, without limitation, silver, gold, copper, bismuth, indium, zinc, antimony, manganese and mixtures thereof. Preferred alloying metals are silver, copper, bismuth, indium, and mixtures thereof, and more preferably silver. It is preferred that the present compositions are free of lead. Any bath-soluble salt of the alloying metal may suitably be used as the source of alloying metal ions. Examples of such alloying metal salts include, but are not limited to: metal oxides; metal halides; metal fluoroborate; metal sulfates; metal alkanesulfonates such as metal methanesulfonate, metal ethanesulfonate and metal propanesulfonate; metal arylsulfonates such as metal phenylsulfonate, metal toluenesulfonate, and metal phenolsulfonate; metal carboxylates such as metal gluconate and metal acetate; and the like. Preferred alloying metal salts are metal sulfates; metal alkanesulfonates; and metal arylsulfonates. When one alloying metal is added to the present compositions, a binary alloy deposit is achieved. When 2, 3 or more different alloying metals are added to the present compositions, tertiary, quaternary or higher order alloy deposits are achieved. The amount of such alloying metal used in the present compositions will depend upon the particular tin-alloy desired. The selection of such amounts of alloying metals is within the ability of those skilled in the art. It will be appreciated by those skilled in the art that when certain alloying metals, such as silver, are used, an additional complexing agent may be required. Such complexing agents (or complexers) are well-known in the art and may be used in any suitable amount.

The present electroplating compositions are suitable for depositing a tin-containing layer, which may be a pure tin layer or a tin-alloy layer. Exemplary tin-alloy layers include, without limitation, tin-silver, tin-copper, tin-indium, tin-bismuth, tin-silver-copper, tin-silver-copper-antimony, tin-silver-copper-manganese, tin-silver-bismuth, tin-silver-indium, tin-silver-zinc-copper, and tin-silver-indium-bismuth. Preferably, the present electroplating compositions deposit pure tin, tin-silver, tin-silver-copper, tin-silver-bismuth, tin-silver-indium, and tin-silver-indium-bismuth, and more preferably pure tin, tin-silver or tin-copper.

Alloys deposited from the present electroplating bath contain an amount of tin ranging from 0.01 to 99.99 wt %, and an amount of one or more alloying metals ranging from 99.99 to 0.01 wt %, based on the weight of the alloy, as measured by either atomic adsorption spectroscopy (AAS), X-ray fluorescence (XRF), inductively coupled plasma (ICP) or differential scanning calorimetry (DSC). Preferably, the tin-silver alloys deposited using the present invention contain from 90 to 99.99 wt % tin and 0.01 to 10 wt % of silver and any other alloying metal. More preferably, the tin-silver alloy deposits contain from 95 to 99.9 wt % tin and 0.1 to 5 wt % of silver and any other alloying metal. Tin-silver alloy is the preferred tin-alloy deposit, and preferably contains from 90 to 99.9 wt % tin and from 10 to 0.1 wt % silver. More preferably, the tin-silver alloy deposits contain from 95 to 99.9 wt % tin and from 5 to 0.1 wt % silver. For many applications, the eutectic composition of an alloy may be used. Alloys deposited according to the present invention are substantially free of lead, that is, they contain 1 wt % lead, more preferably below 0.5 wt %, and yet more preferably below 0.2 wt %, and still more preferably are free of lead.

Bath

In general, besides the metal ion source and at least one of the leveling agents, further referred to as polyimidazolium compounds, the present metal electroplating compositions preferably include electrolyte, i.e. acidic or alkaline electrolyte, one or more sources of metal ions, optionally halide ions, and optionally other additives like surfactants and grain refiners. Such baths are typically aqueous. The water may be present in a wide range of amounts. Any type of water may be used, such as distilled, deionized or tap.

Preferably, the plating baths of the invention are acidic, that is, they have a pH below 7. Typically, the pH of the tin or tin alloy electroplating composition is below 4, preferably below 3, most preferably below 2.

The electroplating baths of the present invention may be prepared by combining the components in any order. It is preferred that the inorganic components such as metal salts, water, electrolyte and optional halide ion source, are first added to the bath vessel followed by the organic components such as surfactants, grain refiners, levelers and the like.

Typically, the plating baths of the present invention may be used at any temperature from 10 to 65 degrees C. or higher. It is preferred that the temperature of the plating baths is from 10 to 35 degrees C. and more preferably from 15 degrees to 30 degrees C.

Suitable electrolytes include such as, but not limited to, sulfuric acid, acetic acid, fluoroboric acid, alkylsulfonic acids such as methanesulfonic acid, ethanesulfonic acid, propanesulfonic acid and trifluoromethane sulfonic acid, arylsulfonic acids such as phenyl sulfonic acid and toluenesulfonic acid, sulfamic acid, hydrochloric acid, phosphoric acid, tetraalkylammonium hydroxide, preferably tetramethylammonium hydroxide, sodium hydroxide, potassium hydroxide and the like. Acids are typically present in an amount in the range of from about 1 to about 300 g/l.

In one embodiment the at least one additive comprises a counterion $Y^{o-}$ selected from chloride, sulfate or acetate. wherein o is a positive integer.

Such electrolytes may optionally contain a source of halide ions, such as chloride ions as in tin chloride or hydrochloric acid. A wide range of halide ion concentrations may be used in the present invention such as from about 0 to about 500 ppm. Typically, the halide ion concentration is in the range of from about 10 to about 100 ppm based on the plating bath. It is preferred that the electrolyte is sulfuric acid or methanesulfonic acid, and preferably a mixture of sulfuric acid or methanesulfonic acid and a source of chloride ions. The acids and sources of halide ions useful in the present invention are generally commercially available and may be used without further purification.

Application

The plating compositions of the present invention are useful in various plating methods where a tin-containing layer is desired, and particularly for depositing a tin-containing solder layer on a semiconductor wafer comprising a plurality of conductive bonding features. Plating methods include, but are not limited to, horizontal or vertical wafer plating, barrel plating, rack plating, high speed plating such as reel-to-reel and jet plating, and rackless plating, and preferably horizontal or vertical wafer plating. A wide variety of substrates may be plated with a tin-containing deposit according to the present invention. Substrates to be plated are conductive and may comprise copper, copper alloys, nickel, nickel alloys, nickel-iron containing materials. Such substrates may be in the form of electronic components such as (a) lead frames, connectors, chip capacitors, chip resistors, and semiconductor packages, (b) plastics such as circuit boards, and (c) semiconductor wafers. Preferably the substrates are semiconductor wafers. Accordingly, the present invention also provides a method of depositing a tin-containing layer on a semiconductor wafer comprising: providing a semiconductor wafer comprising a plurality of conductive bonding features; contacting the semiconductor wafer with the composition described above; and applying sufficient current density to deposit a tin-containing layer on the conductive bonding features. Preferably, the bonding features comprise copper, which may be in the form of a pure copper layer, a copper alloy layer, or any interconnect structure comprising copper. Copper pillars are one preferred conductive bonding feature. Optionally, the copper pillars may comprise a top metal layer, such as a nickel layer. When the conductive bonding features have a top metal layer, then the pure tin solder layer is deposited on the top metal layer of the bonding feature. Conductive bonding features, such as bonding pads, copper pillars, and the like, are well-known in the art, such as described in U.S. Pat. No. 7,781,325, US 2008/0054459 A, US 2008/0296761 A, and US 2006/0094226 A.

Process

In general, when the present invention is used to deposit tin or tin alloys on a substrate the plating baths are agitated during use. Any suitable agitation method may be used with the present invention and such methods are well-known in the art. Suitable agitation methods include, but are not limited to, inert gas or air sparging, work piece agitation, impingement and the like. Such methods are known to those skilled in the art. When the present invention is used to plate an integrated circuit substrate, such as a wafer, the wafer may be rotated such as from 1 to 150 RPM and the plating solution contacts the rotating wafer, such as by pumping or spraying. In the alternative, the wafer need not be rotated where the flow of the plating bath is sufficient to provide the desired metal deposit.

The tin or tin alloy is deposited in recesses according to the present invention without substantially forming voids within the metal deposit. By the term "without substantially forming voids", it is meant that there are no voids in the metal deposit which are bigger than 1000 nm, preferably 500 nm, most preferably 100 nm.

Plating equipment for plating semiconductor substrates are well known. Plating equipment comprises an electroplating tank which holds tin or tin alloy electrolyte and which is made of a suitable material such as plastic or other material inert to the electrolytic plating solution. The tank may be cylindrical, especially for wafer plating. A cathode is horizontally disposed at the upper part of tank and may be any type substrate such as a silicon wafer having openings.

These additives can be used with soluble and insoluble anodes in the presence or absence of a membrane or membranes separating the catholyte from the anolyte.

The cathode substrate and anode are electrically connected by wiring and, respectively, to a power supply. The cathode substrate for direct or pulse current has a net negative charge so that the metal ions in the solution are reduced at the cathode substrate forming plated metal on the cathode surface. An oxidation reaction takes place at the anode. The cathode and anode may be horizontally or vertically disposed in the tank.

In general, when preparing tin or tin alloy bumps, a photoresist layer is applied to a semiconductor wafer, followed by standard photolithographic exposure and development techniques to form a patterned photoresist layer (or plating mask) having openings or vias therein. The dimensions of the plating mask (thickness of the plating mask and the size of the openings in the pattern) defines the size and location of the tin or tin alloy layer deposited over the I/O pad and UBM. The diameter of such deposits typically range from 1 to 300 μm, preferably in the range from 2 to 100 μm.

All percent, ppm or comparable values refer to the weight with respect to the total weight of the respective composition except where otherwise indicated. All cited documents are incorporated herein by reference.

The following examples shall further illustrate the present invention without restricting the scope of this invention.

Methods Used Herein

The molecular weight of the polymeric ionic compounds was determined by size-exclusion chromatography (SEC). For leveler 3 poly(methyl methacrylate) was used as standard and water hexaflouro-isopropanol comprising 0.05% (w/w) potassium-trifluoroacetate as effluent. For leveler 1 and 2 poly(2-vinylpyridin) was used as standard and water comprising 0.1% (w/w) trifluoroacetate and 0.1 M NaCl as effluent. The temperature of the column was 35° C., the injected volume 100 μL (μliter), the concentration 1.5 mg/ml and the flow rate 0.8 ml/min. The weight average molecular weight ($M_w$), the number average molecular weight ($M_n$) and the polydispersity PDI ($M_w/M_n$) of the polymeric ionic compounds were determined.

Coplanarity and morphology (roughness) was determined by measuring the height of the substrate by laser scanning microscopy.

The patterned photoresist contained vias of 8 μm diameter and 15 μm depth and pre-formed copper p-bump of 5 μm height. The isolated (iso)-area consists of a 3×6 array of pillars with a center to center distance (pitch) of 32 μm. The dense area consists of an 8×16 array of pillars with a center to center distance (pitch) of 16 μm. For the calculation of the within die coplanarity 3 bumps of the iso-area and 3 bumps from the center of the dense area are taken.

The Within Die (WID) coplanarity (COP) was determined by using formula $$COP=(H_{iso}-H_{dense})/H_{AV}$$

Herein $H_{iso}$ and $H_{dense}$ are the average heights of the bumps in the iso/dense area and $H_{AV}$ is the overall average height of all bumps in the iso and dense area as described above.

The Average Roughness $R_a$ was calculated by using formula $$R_a = \frac{1}{n}\sum_{i=1}^{n}|H_i - H_{mean}|$$

Herein $H_i$ is the height of location i on a certain bump. During a laser scan of the surface of one bump the height of n locations is determined. $H_{mean}$ is the average height of all n locations of one bump.

EXAMPLES

Example 1

Leveler Preparation

Leveler 1

14 mol acetic acid and 700 g of water were placed in a flask. A mixture of 7.2 mol formaldehyde (49% aq. Solution) and 7.2 Mol glyoxal (40% aq. Solution) was added via a dropping funnel to the solution. In parallel, a mixture of 7 mol of 1,6-diaminohexane and 350 g water was added to the solution via a separated dropping funnel. During addition of the monomers the reaction mixture was held at room temperature by ice bath cooling. After completion of the addition the reaction mixture was heated to 100° C. for 1 hours. The crude product was used as received. $M_w$=108000 g/mol, $M_n$=5300 g/mol, and PDI=20.

Leveler 2

2 mol acetic acid and 100 g of water were placed in a flask. A mixture of 1 mol of Isophoronediamine and 50 g water was added dropwise to the solution. During addition of the amine the reaction mixture was held at room temperature by ice bath cooling. A mixture of 1 mol formaldehyde (49% aq. Solution) and 1 mol glyoxal (40% aq. Solution) was added via a dropping funnel to the solution in 1 h. After completion of the addition the reaction mixture was heated to 100° C. for 1 hours. The crude product was used as received. $M_w$=6290 g/mol, $M_n$=2100 g/mol, and PDI=3.

Leveler 3

9 Mol acetic acid and 250 g of water were placed in flask. A mixture of 4.5 mol formaldehyde (49% aq. Solution) and 4.5 Mol glyoxal (40% aq. Solution) was added via a dropping funnel to the solution. In parallel, 4.5 mol of m-Xylylendiamine was added to the solution via a separated dropping funnel. After dosage of roughly 2 mols of diamine and carbonyl compounds another 200 g of water were added to the reaction mixture and the addition was continued. During addition of the monomers the reaction mixture was held at room temperature by ice bath cooling. After completion of the addition the reaction mixture was heated to 100° C. for 1 hour. The crude product is used as received. $M_w$=17000 g/mol, $M_n$=7100 g/mol, and PDI=2.4

Example 2

Tin Electroplating

Comparative Example 2.1

A tin plating bath containing 40 g/l tin as tin methane sulfonate, 165 g/l methane sulfonic acid, 1 g/l p-methoxyphenol (commercial anti-oxidant) and 1 g/l Lugalvan BNO 12 (available from BASF) has been prepared. Lugalvan BNO 12 is a β-naphthol ethoxylated with 12 moles ethylene oxide per mole β-naphthol. 5 μm tin was electroplated on a nickel covered copper micro-bump. The copper micro-bump had a diameter of 8 μm and a height of 5 μm. The nickel layer was 1 μm thick. A 2 cm×2 cm large wafer coupon with a 15 μm thick patterned photo resist layer has been immersed in the above described plating bath and a direct current of 16 ASD has been applied for 37 s at 25° C. The plated tin bump was examined with a laser scanning microscope (LSM, model VK-X200 series from Keyence) and scanning electron microscopy (SEM). A mean roughness (Ra) of 0.4 μm and a coplanarity (COP) of 4% has been determined. The results are summarized in Table 1.

As can be revealed from FIG. 1, Lugalvan BNO 12—a common surfactant for tin plating—results in a rough surface of the plated tin bump.

Comparative Example 2.2

A tin plating bath as described in Example 2.1 containing additional 0.02 g/l benzylidene acetone as grain refiner and 10 ml/l isopropanol has been prepared.

The plating procedure was the one described in Example 2.1.

The plated tin bump was examined with a laser scanning microscope (LSM) and scanning electron microscopy (SEM). A mean roughness (Ra) of 0.12 μm and a coplanarity (COP) of −11% has been determined. The results are summarized in Table 1.

Figure 2:
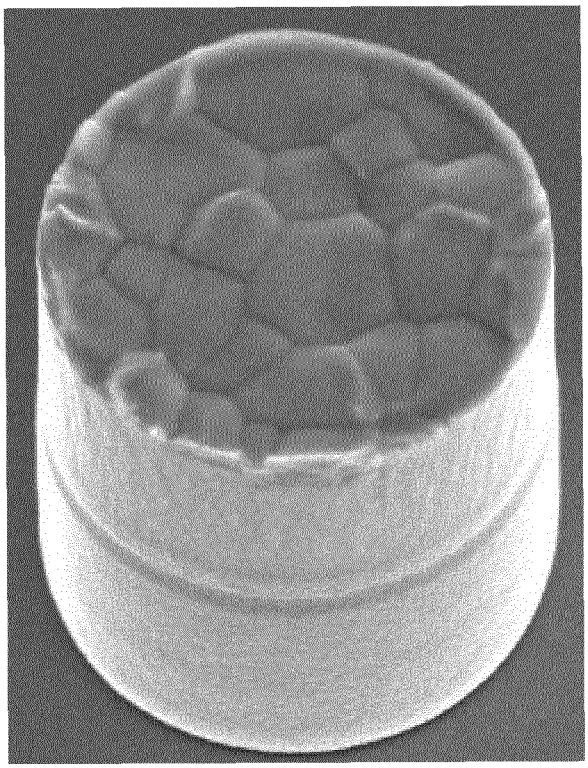
FIG. 2 shows a SEM image of a tin bump electroplated according to Comparative Example 2.2.

As can be revealed from FIG. 2, adding benzylidene acetone to the plating bath of Example 2.1 leads to a smoother, but still unsatisfactory, surface accompanied with an increased coplanarity (less uniform plating height) compared to the example in FIG. 1.

Example 2.3

A tin plating bath as described in Example 2.1 containing additional 1 g/l of Leveler 1 has been prepared. The plating procedure was the one described in Example 2.1. The plated tin bump was examined with a laser scanning microscope (LSM) and scanning electron microscopy (SEM). A mean roughness (Ra) of 0.18 μm and a coplanarity (COP) of 5% has been determined. The results are summarized in Table 1.

Figure 3:
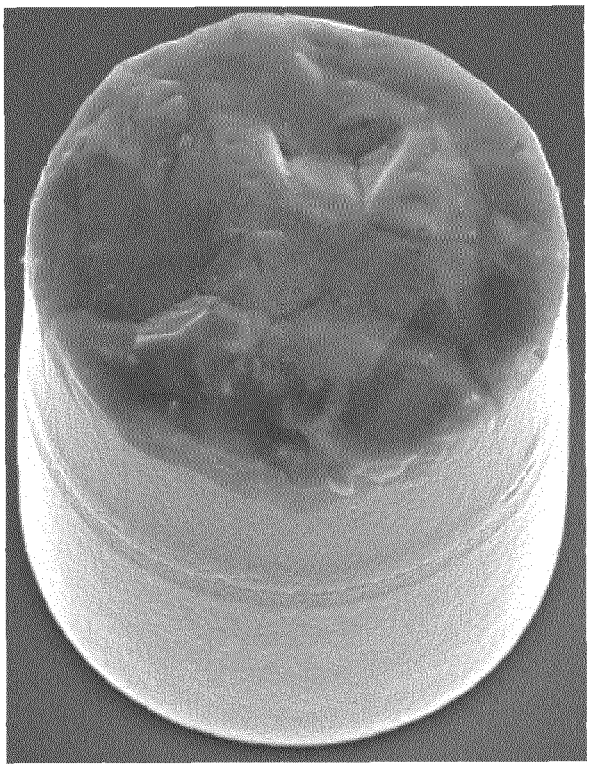
FIG. 3 shows a SEM image of a tin bump electroplated according to Example 2.3.

As can be revealed from FIG. 3, adding Leveler 1 to the plating bath of Example 2.1 leads to a smooth surface in combination with a uniform plating height in contrast to the example of Example 2.2, even without the use of a grain refiner.

Example 2.4

A tin plating bath as described for Example 2.1 containing additional 1 g/l of Leveler 2 has been prepared. The plating procedure was the one described in FIG. 1. The plated tin bump was examined with a laser scanning microscope (LSM) and scanning electron microscopy (SEM). A mean roughness (Ra) of 0.17 μm and a coplanarity (COP) of 3% has been determined. The results are summarized in Table 1.

Figure 4:
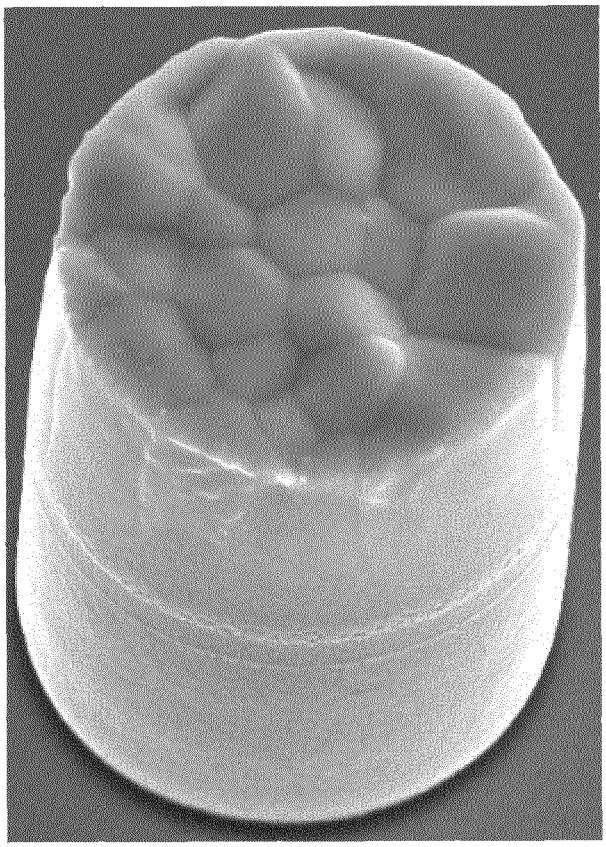
FIG. 4 shows a SEM image of a tin bump electroplated according to Example 2.4.

As can be revealed from FIG. 4, adding Leveler 2 to the plating bath of Example 2.1 leads to a smooth surface in combination with a uniform plating height in contrast to Example 2.2, even without the use of a grain refiner.

Example 2.5

A tin plating bath as described in Example 2.1 containing additional 1 g/l of Leveler 3 has been prepared. The plating procedure was the one described in Example 2.1. The plated tin bump was examined with a laser scanning microscope (LSM) and scanning electron microscopy (SEM). A mean roughness (Ra) of 0.13 μm and a coplanarity (COP) of 0% has been determined. The results are summarized in Table 1.

Figure 5:
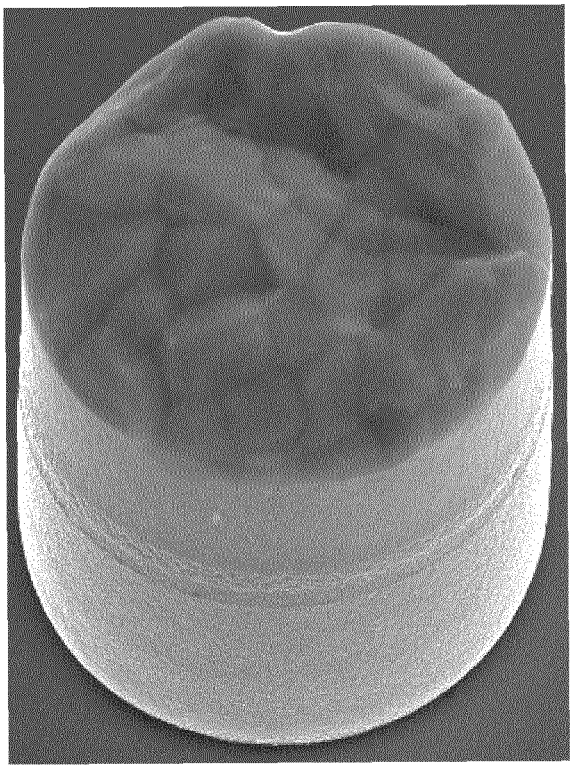
FIG. 5 shows a SEM image of a tin bump electroplated according to Example 2.5.

As can be revealed from FIG. 5, adding Leveler 3 to the plating bath of FIG. 1 leads to a smooth surface in combination with a uniform plating height in contrast to the example of Example 2.2, even without the use of a grain refiner.

TABLE 1

| Example | Leveler | Grain Refiner | $X^1$ in Formula L1 | $R_a$ [μm] | COP [%] |
|---|---|---|---|---|---|
| 2.1 | — | — | — | 0.4 | 4 |
| 2.2 | — | benzylidene acetone | — | 0.12 | −11 |
| 2.3 | Leveler 1 | none | hexanediyl | 0.18 | 5 |
| 2.4 | Leveler 2 | none | isophorone | 0.17 | 3 |
| 2.5 | Leveler 3 | none | xylylene | 0.13 | 0 |

Example 3

Tin Copper Electroplating

Comparative Example 3.1

A tin-copper plating bath containing 65 g/l tin as tin methanesulfonate, 0.5 g/l copper as copper methanesulfonate, 180 g/l methanesulfonic acid, 2 g/l p-methoxyphenol (commercial anti-oxidant) and 1 g/l Lugalvan BNO 12 (available from BASF) has been prepared. Lugalvan BNO 12 is a β-naphthol ethoxylated with 12 moles ethylene oxide per mole β-naphthol. 5 μm tin-copper alloy was electroplated on a copper micro-bump. The copper micro-bump had a diameter of 8 μm and a height of 5 μm. A 2 cm×2 cm large wafer coupon with a 15 μm thick patterned photo resist layer has been immersed in the above described plating bath and a direct current of 16 ASD has been applied for 35 s at 25° C. The plated tin-copper bump was examined with a laser scanning microscope (LSM, model VK-X200 series from Keyence) and scanning electron microscopy (SEM). A mean roughness (Ra) of 0.51 μm has been determined. The result is listed in Table 2.

Figure 6:
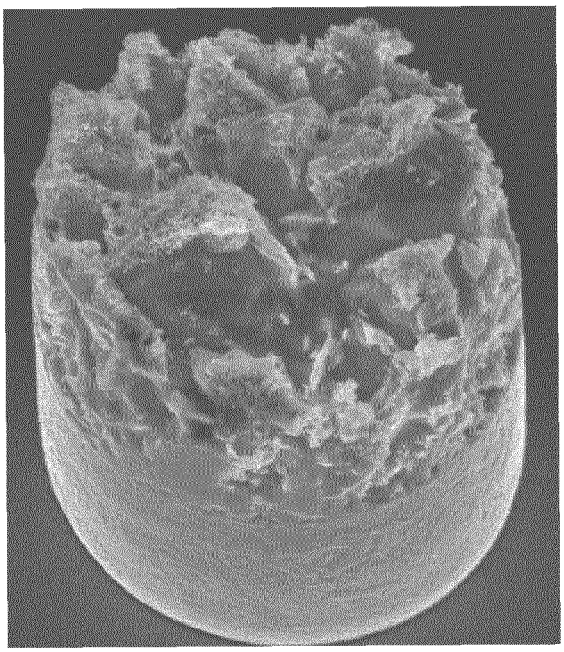
FIG. 6 shows a SEM image of a tin copper alloy bump electroplated according to Comparative Example 3.1.

As can be revealed from FIG. 6, Lugalvan BNO 12—a common surfactant for tin plating—results in a rough surface of the plated tin-copper bump.

Example 3.2

A tin-copper plating bath as described in Example 3.1 containing additional 1 g/l of Leveler 3 has been prepared. The plating procedure was the one described in Example 3.1. The plated tin-copper bump was examined with a laser scanning microscope (LSM) and scanning electron microscopy (SEM). A mean roughness (Ra) of 0.32 μm has been determined. The result is listed in Table 2.

Figure 7:
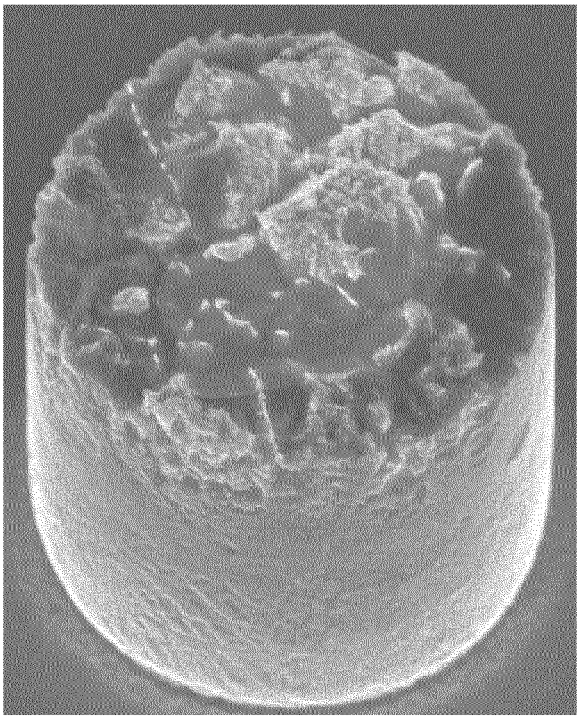
FIG. 7 shows a SEM image of a tin copper alloy bump electroplated according to Example 3.2.

As can be revealed from FIG. 7, adding Leveler 3 to the plating bath of Example 3.1 leads to a smoother surface.

Example 4

Tin Silver Electroplating

Comparative Example 4.1

A tin-silver plating bath containing 75 g/l tin as tin methanesulfonate, 1 g/l silver as silver methanesulfonate, 3.4 g/l 3,6-Dithio-1,8-octanediol, 165 g/l methanesulfonic acid, 2 g/l p-methoxyphenol (commercial anti-oxidant) and 1 g/l Lugalvan BNO 12 (available from BASF) has been prepared. Lugalvan BNO 12 is a β-naphthol ethoxylated with 12 moles ethylene oxide per mole β-naphthol. 17 μm tin-silver alloy was electroplated on a copper seed of a bump substrate. The bump substrate consisted of a patterned photo resist with vias of 50 μm diameter and 56 μm depth. A 2 cm×2 cm large wafer coupon has been immersed in the above described plating bath and a direct current of 10 ASD has been applied for 202 s at 25° C. The plated tin-silver bump was examined with a laser scanning microscope (LSM, model VK-X200 series from Keyence) and scanning electron microscopy (SEM). A mean roughness (Ra) of 0.86 μm has been determined. The result is listed in Table 2.

Figure 8:
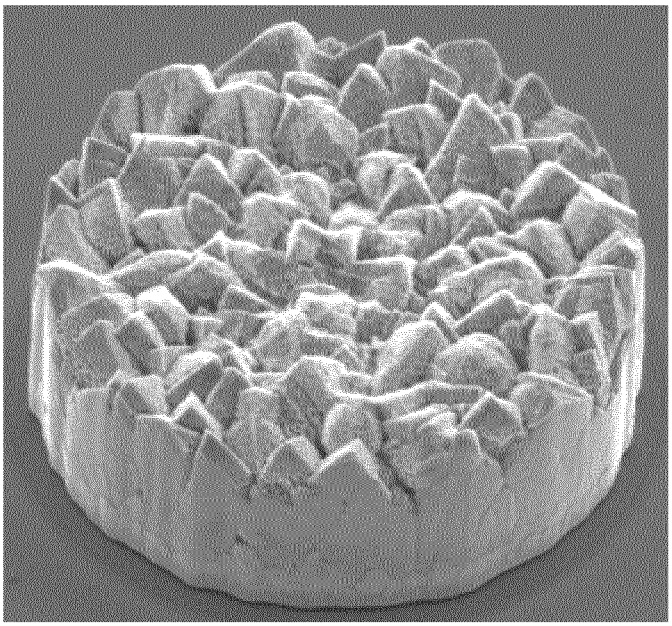
FIG. 8 shows a SEM image of a tin silver alloy bump electroplated according to Comparative Example 4.1.

As can be revealed from FIG. 8, Lugalvan BNO 12—a common surfactant for tin plating—results in a rough surface of the plated tin-silver bump.

Example 4.2

A tin-silver plating bath as described in Example 4.1 containing additional 1 g/l of Leveler 3 has been prepared.

The plating procedure was the one described in Example 4.1. The plated tin-silver bump was examined with a laser scanning microscope (LSM) and scanning electron microscopy (SEM). A mean roughness (Ra) of 0.50 μm has been determined. The result is listed in Table 1.

Figure 9:
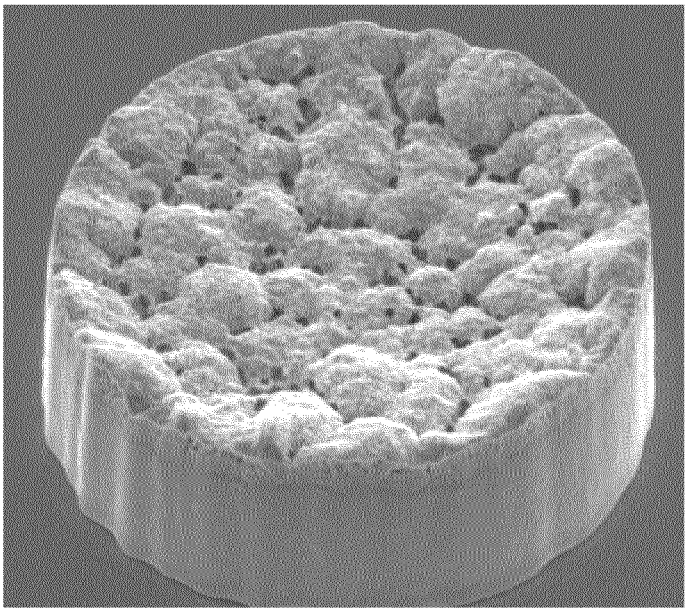
FIG. 9 shows a SEM image of a tin silver alloy bump electroplated according to Example 4.2.

As can be revealed from FIG. 9, adding Leveler 3 to the plating bath of Example 4.1 leads to a smoother surface.

TABLE 2

| Example | Alloy | Feature Geometry | Leveler | $X^1$ in Formula L1 | $R_a$ [μm] |
|---|---|---|---|---|---|
| 3.1 | SnCu | 8 × 15 | — | — | 0.51 |
| 3.2 | SnCu | 8 × 15 | Leveler 3 | xylylene | 0.32 |
| 4.1 | SnAg | 50 × 56 | — | — | 0.86 |
| 4.2 | SnAg | 50 × 56 | Leveler 3 | xylylene | 0.50 |

The invention claimed is:

1. An aqueous composition, comprising:

tin ions;

at least one alloy metal ion selected from the group consisting of silver, indium, and bismuth ions; and at least one additive comprising a linear or branched polyimidazolium compound comprising a structural unit of formula (L1):

(L1)

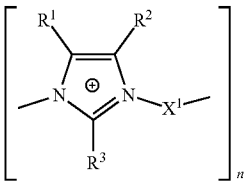

wherein:

$R^1$, $R^2$, $R^3$ are each independently selected from the group consisting of an H atom and an organic radical having from 1 to 20 carbon atoms;

$X^1$ is a group —$Y^2$—$Y^1$—$Y^2$—, with the proviso that $X^1$ does not comprise a hydroxyl group in the α or β positions relative to the nitrogen atoms of the imidazole rings;

$Y^1$ is selected from the group consisting of phenyl, naphtyl, pyridyl, pyrimidyl, and furanyl;

$Y^2$ is independently selected from methanediyl, ethanediyl, 1,3-propanediyl and 1,4-butanediyl; and n is an integer from 5 to 5000.

2. The composition according to claim 1, wherein $R^1$ and $R^2$ are H atoms.

3. The composition according to claim 1, wherein $R^3$ is an H atom or methyl, ethyl or propyl.

4. The composition according to claim 1, wherein $X^1$ does not comprise any hydroxyl groups.

5. The composition according to claim 1, wherein the at least one additive comprises a counterion $Y^{o-}$ selected from the group consisting of chloride, sulfate and acetate, wherein o is a positive integer.

6. The composition according to claim 1, wherein the pH of the composition is below 4.

7. The composition according to claim 1, wherein the mass average molecular weight $M_w$ of the polyimidazolium compound, determined by gel permeation chromatography, is from 500 g/mol to 1,000,000 g/mol.

8. The composition according to claim 1, wherein the polyimidazolium compound comprises more than 80% by weight of structural units of the formula (L1).

9. The composition according to claim 1, further comprising:

an additive selected from the group consisting of one or more surfactants and one or more grain refiners.

10. A bath for depositing at least one tin alloy containing layer, the bath comprising an additive including a linear or branched polyimidazolium compound comprising a structural unit of formula (L1):

(L1)

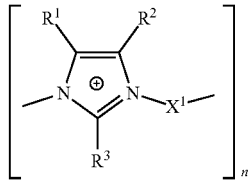

wherein:

the at least one tin alloy containing layer comprises an alloy metal selected from the group consisting of silver, copper, indium, and bismuth in an amount of 0.01 to 10% by weight;

$R^1$, $R^2$, $R^3$ are each independently selected from the group consisting of an H atom and an organic radical having from 1 to 20 carbon atoms, $X^1$ is a group —$Y^2$—$Y^1$—$Y^2$—, with the proviso that $X^1$ does not comprise a hydroxyl group in the α or β positions relative to the nitrogen atoms of the imidazole rings;

$Y^1$ is selected from the group consisting of phenyl, naphtyl, pyridyl, pyrimidyl, and furanyl;

$Y^2$ is independently selected from methanediyl, ethanediyl, 1,3-propanediyl and 1,4-butanediyl; and n is an integer from 5 to 5000.

11. The bath according to claim 10, wherein the at least one tin alloy containing layer has an alloy metal content of 0.1 to 5% by weight.

12. A process for depositing a tin alloy layer on a substrate, the process comprising:

a) contacting a tin alloy electroplating bath with a substrate, the tin alloy electroplating bath comprising a composition comprising:

tin ions;

at least one alloy metal ion selected from the group consisting of silver, copper, indium, and bismuth ions; and at least one additive comprising a linear or branched polyimidazolium compound comprising a structural unit of formula (L1):

(L1)

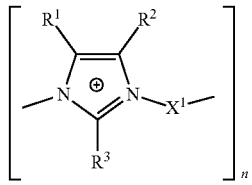

wherein:

$R^1$, $R^2$, $R^3$ are each independently selected from the group consisting of an H atom and an organic radical having from 1 to 20 carbon atoms;

$X^1$ is a group —$Y^2$—$Y^1$—$Y^2$—, with the proviso that $X^1$ does not comprise a hydroxyl group in the α or β positions relative to the nitrogen atoms of the imidazole rings, $Y^1$ is selected from the group consisting of phenyl, naphtyl, pyridyl, pyrimidyl, and furanyl;

$Y^2$ is independently selected from methanediyl, ethanediyl, 1,3-propanediyl and 1,4-butanediyl; and n is an integer from 5 to 5000; and b) applying a current density to the substrate for a time sufficient to deposit a tin alloy layer onto the substrate, wherein the alloy metal content of the deposited tin alloy layer is from 0.01 to 10% by weight.

13. The process according to claim 12, wherein the substrate comprises micrometer sized features and the deposition is performed to fill the micrometer sized features.

14. The process according to claim 13, wherein the micrometer sized features have a size from 1 to 200 micrometers.

* * * * *